US011285357B1

(12) United States Patent
Gorin

(10) Patent No.: US 11,285,357 B1
(45) Date of Patent: Mar. 29, 2022

(54) PHYSICAL THERAPY BOOT

(71) Applicant: Kurt Gorin, South River, NJ (US)

(72) Inventor: Kurt Gorin, South River, NJ (US)

( * ) Notice: Subject to any disclaimer, the term of this patent is extended or adjusted under 35 U.S.C. 154(b) by 27 days.

(21) Appl. No.: 16/936,538

(22) Filed: Jul. 23, 2020

(51) Int. Cl.

| | |
|---|---|
| ***A63B 21/00*** | (2006.01) |
| ***A63B 23/04*** | (2006.01) |
| ***A63B 24/00*** | (2006.01) |
| ***A63B 71/04*** | (2006.01) |
| ***A43B 7/00*** | (2006.01) |
| ***A63B 21/02*** | (2006.01) |
| ***A63B 22/20*** | (2006.01) |
| ***A63B 22/00*** | (2006.01) |

(52) U.S. Cl.
CPC ..... *A63B 21/4015* (2015.10); *A43B 7/00* (2013.01); *A63B 21/028* (2013.01); *A63B 22/20* (2013.01); *A63B 22/203* (2013.01); *A63B 23/0494* (2013.01); *A63B 24/0062* (2013.01); *A63B 71/04* (2013.01); *A63B 2022/0094* (2013.01); *A63B 2225/54* (2013.01)

(58) Field of Classification Search
CPC ... A63B 21/4015; A63B 22/20; A63B 22/203; A63B 21/028; A63B 71/04; A63B 24/0062; A63B 23/0494; A63B 2022/0094; A63B 2225/54; A63B 21/4037; A63B 22/201; A63B 23/0458; A63B 23/0464; A63B 23/0405; A63B 26/00; A43B 7/00
See application file for complete search history.

(56) References Cited

U.S. PATENT DOCUMENTS

| | | | | |
|---|---|---|---|---|
| 5,127,892 | A * | 7/1992 | Sawdon | A63B 23/10 482/79 |
| 5,352,165 | A * | 10/1994 | Koblick | A63B 69/0057 482/148 |
| 5,509,870 | A * | 4/1996 | Lloyd | A63B 21/4037 482/13 |
| 5,800,312 | A * | 9/1998 | Ormondroyd | A63B 69/0026 482/70 |
| 7,955,230 | B1 | 6/2011 | Al-Oboudi | |
| 8,142,336 | B1 * | 3/2012 | Yates | A63B 23/0405 482/79 |
| 9,616,283 | B1 | 4/2017 | Heineck | |
| 10,561,898 | B1 * | 2/2020 | Flythe | A63B 23/0458 |
| 2011/0230313 | A1 * | 9/2011 | Gamboa | A63B 23/12 482/51 |

(Continued)

*Primary Examiner* — Sundhara M Ganesan
(74) *Attorney, Agent, or Firm* — Sanchelima & Associates, P.A.; Christian Sanchelima

(57) ABSTRACT

A physical therapy system including a boot assembly, a track assembly and a communications assembly is disclosed. The boot assembly includes a boot that is worn on the foot of the user with the knee that requires treatment. The boot includes a cushioned sole provided by a sponge within the boot. The sponge being entirely enclosed by a cover. The track assembly includes a track on which the boot is maneuvered on. The boot and the track having a low friction coefficient to allow the boot to easily slid on the track. The user may maneuver the boot in a manner that rehabilitates their knee. Within the boot is the communication assembly which includes a processor and sensors to gather data from the usage of the boot. The collected data is communicated to a mobile device allowing a user to track their therapy sessions and progress.

17 Claims, 3 Drawing Sheets

(56) References Cited

U.S. PATENT DOCUMENTS

| | | | | |
|---|---|---|---|---|
| 2012/0010051 | A1* | 1/2012 | Bruschke | A63B 69/0022 482/51 |
| 2012/0190516 | A1* | 7/2012 | Geotsalitis | A63B 22/20 482/142 |
| 2012/0289378 | A1* | 11/2012 | Sperry | A63B 22/18 482/8 |
| 2013/0090218 | A1* | 4/2013 | Johnson | A63B 21/0552 482/124 |
| 2013/0217552 | A1* | 8/2013 | Slotnick | A63B 21/4037 482/142 |
| 2013/0239440 | A1* | 9/2013 | Santos | A63B 21/4033 36/136 |
| 2014/0287894 | A1* | 9/2014 | Austin | A63B 21/4037 482/142 |
| 2015/0343263 | A1* | 12/2015 | Sampath | A63B 23/04 482/8 |
| 2017/0050082 | A1* | 2/2017 | Whitaker | A63B 23/03508 |
| 2017/0072259 | A1* | 3/2017 | Trenkle | A63B 21/4034 |
| 2018/0169462 | A1* | 6/2018 | Jorstad | A63B 23/0205 |
| 2018/0221704 | A1* | 8/2018 | Markus | A63B 21/4037 |
| 2018/0280756 | A1* | 10/2018 | Nakashima | A63B 24/0062 |
| 2018/0303191 | A1* | 10/2018 | Poremba | A43B 3/122 |
| 2018/0318639 | A1* | 11/2018 | Kim | A63B 21/068 |
| 2018/0326286 | A1* | 11/2018 | Rathi | A43B 5/1641 |
| 2019/0366155 | A1* | 12/2019 | Takizawa | A63B 22/203 |
| 2020/0261761 | A1* | 8/2020 | Chapman | A63B 21/0557 |
| 2020/0276496 | A1* | 9/2020 | Tugra | G06F 3/014 |
| 2020/0289892 | A1* | 9/2020 | DeCesare | A63B 24/0062 |
| 2020/0316429 | A1* | 10/2020 | Markus | A63B 21/4037 |

* cited by examiner

PHYSICAL THERAPY BOOT

BACKGROUND OF THE INVENTION

1. Field of the Invention

The present invention relates to a physical therapy boot and, more particularly, to a physical therapy boot that helps to rehabilitate and strengthen the knees of users.

2. Description of the Related Art

Several designs for physical therapy boots have been designed in the past. None of them, however, include a physical therapy system comprising a portable sliding track, and a therapeutic boot having a cushioned sole covered with a low friction fabric or material. The present invention helps to strengthen and rehabilitate the knees of users after an injury. The physical therapy system additionally is portable for ease of transportation. Allowing users to remain consistent and disciplined with the rehabilitation leading to a successful recovery.

Applicant believes that a related reference corresponds to U.S. Pat. No. 9,616,283 for a therapeutic device that has a slide-ably mounted foot plat that allows the user to move their feet in a reciprocating manner. Applicant believes that another related reference corresponds with U.S. Pat. No. 7,955,230 for a therapy device that is worn on the foot of a patient and provides a slidable surface that allos relatively easy sliding of the toe section of the floor. None of these references, however, teach of a physical therapy system including a portable sliding track, and a therapeutic boot having a cushioned sole covered with a low friction material.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a physical therapy system that helps users to rehabilitate and strength the knees of the users.

It is another object of this invention to provide a physical therapy system that is portable and easily transported.

It is still another object of the present invention to provide a physical therapy system that is easy to operate allowing users with different injury severity to comfortably receive treatment.

It is also another object of the present invention to provide a physical therapy system that allows users to be more consistent and disciplined with their physical therapy treatment.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
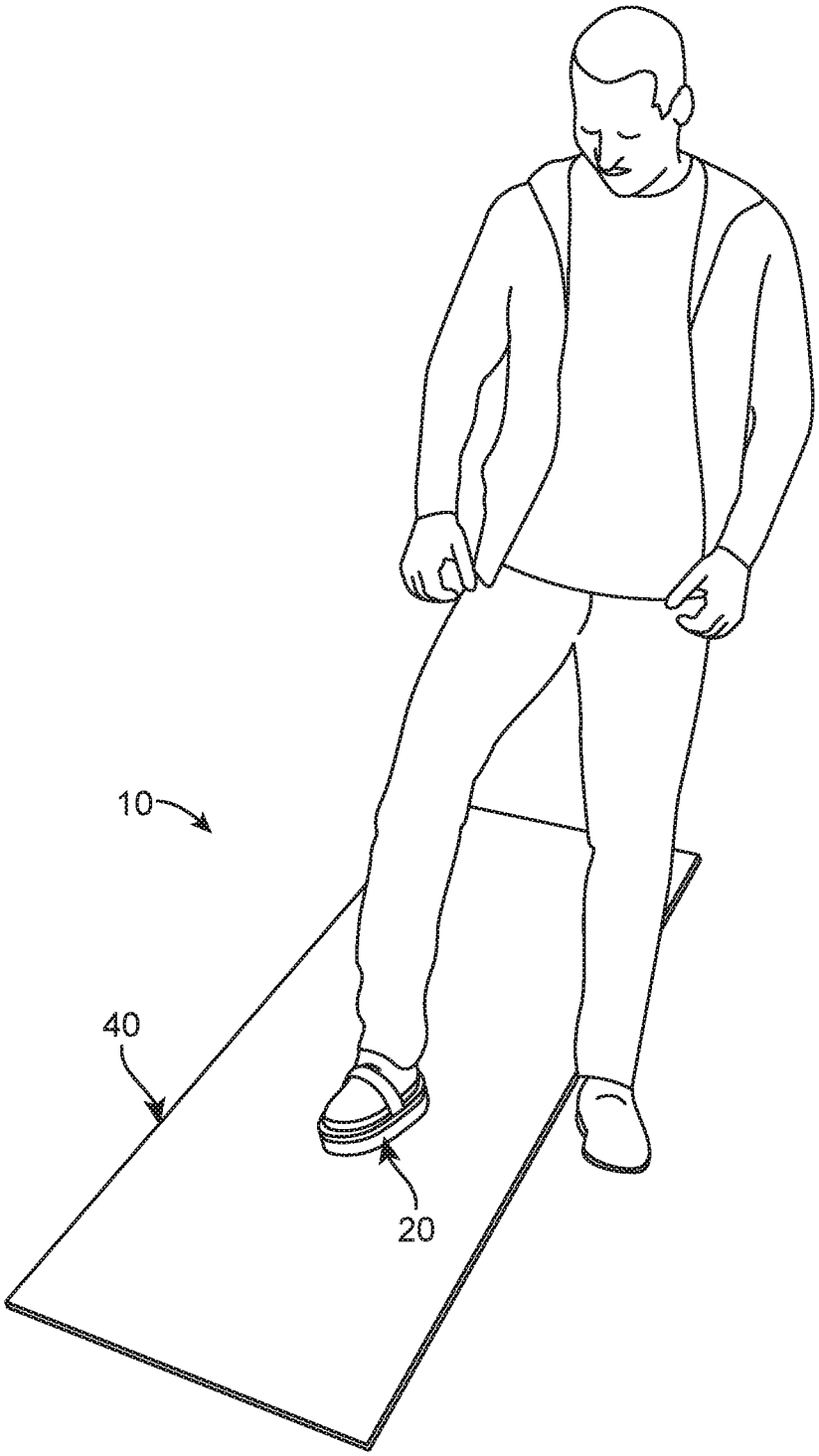
FIG. 1 represents an operational view of the physical therapy system 10 being operated by a user to rehabilitate a knee of the user.

Referring now to the drawings, where the present invention is generally referred to with numeral 10, it can be observed that it basically includes a boot assembly 20, a track assembly 40 and a communications assembly 60.

Physical therapy system 10 may be used during physical therapy treatment to help patients or users recover from an injury. Preferably, physical therapy system 10 may help users to strength and rehabilitate the knees of the user, as best seen in FIG. 1. Mobility for the user is also improved with physical therapy system 10. With the physical therapy treatment being readily available to the users, the users may be more consistent and disciplined with the therapy leading to a better and more successful recovery. Physical therapy system 10 may be easily transported allowing users to receive treatment even away from home.

Figure 2:
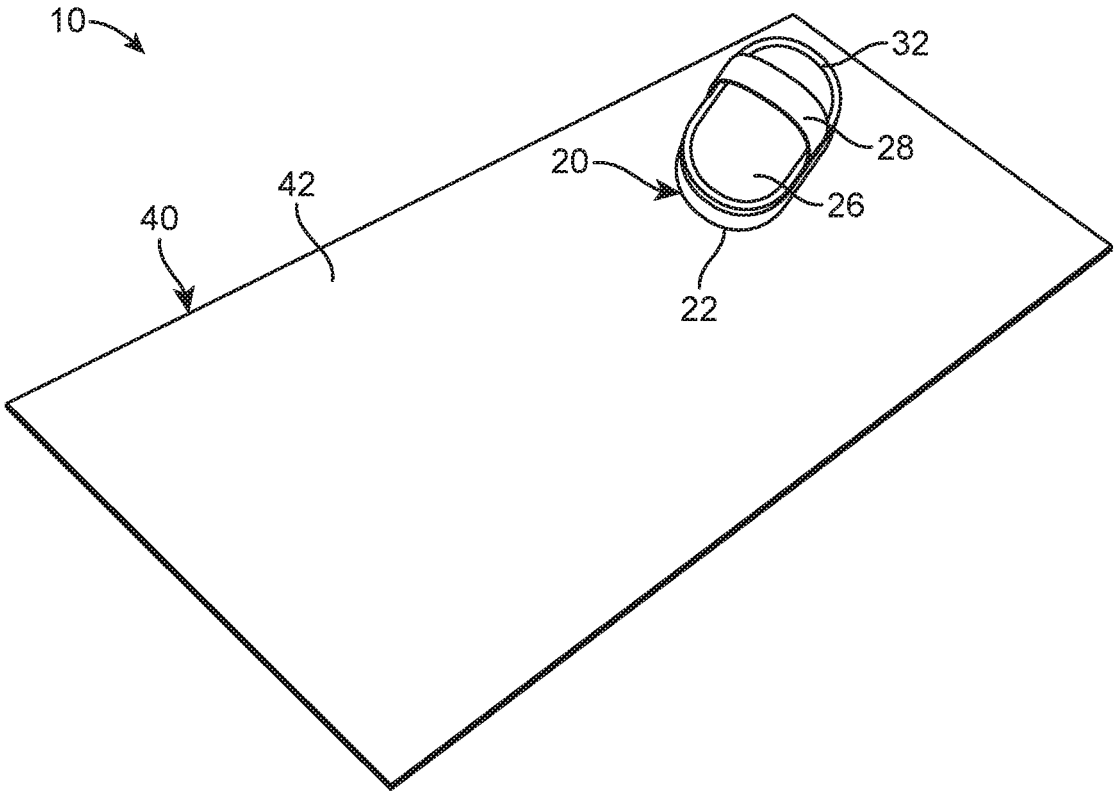
FIG. 2 shows an isometric view of the boot 22 and track 42.
Figure 3:
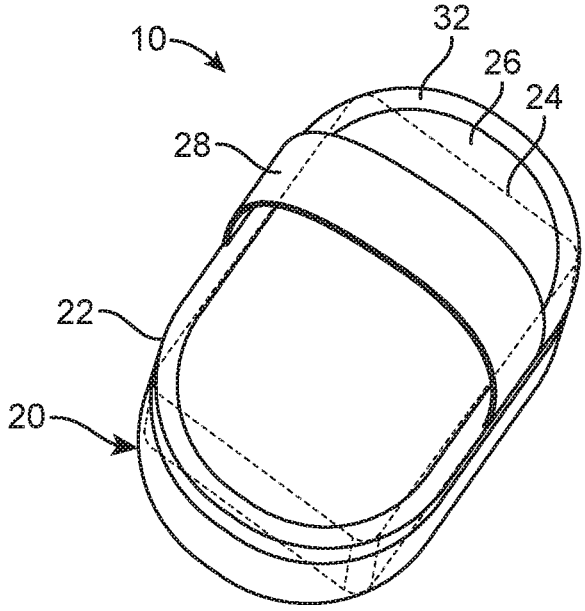
FIG. 3 illustrates an isometric view of boot 22.
Figure 4:
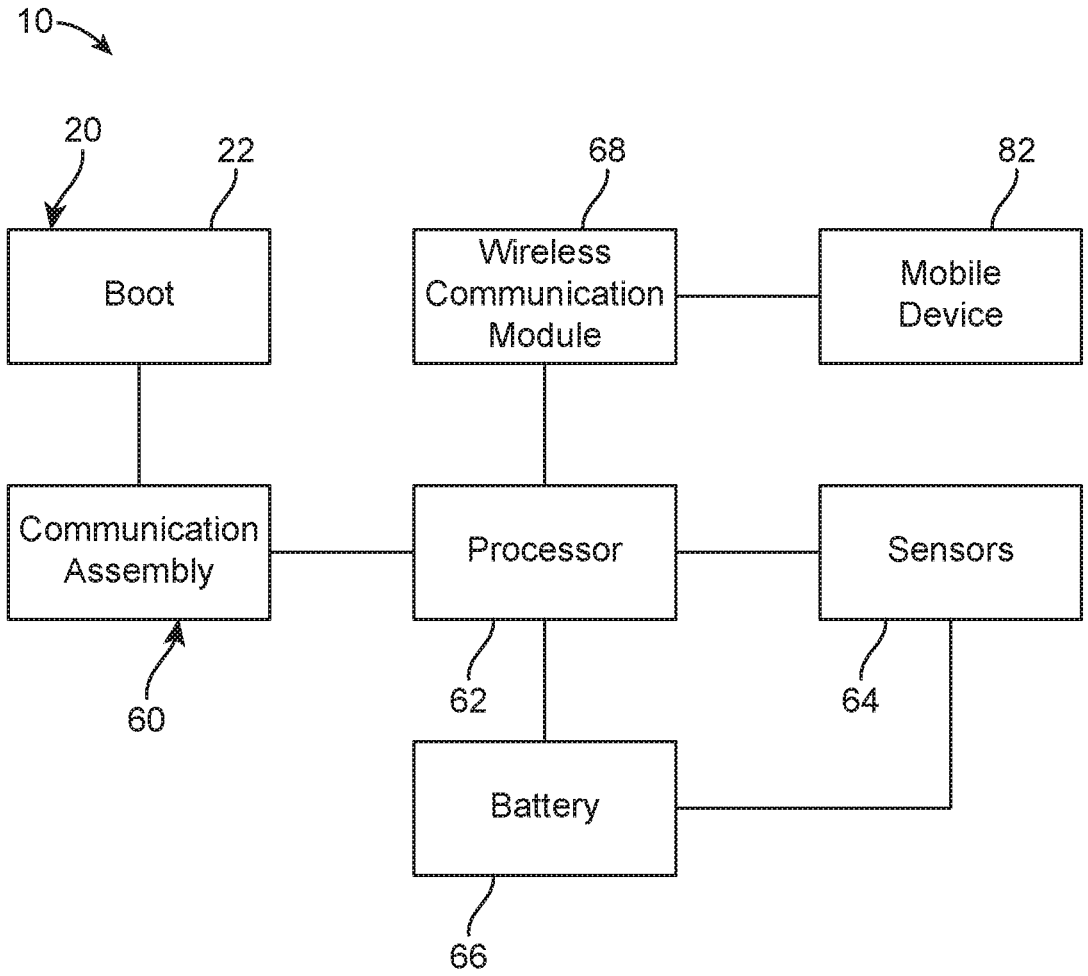
FIG. 4 is a representation of a flowchart of communication assembly 60.

Physical therapy system 10 may include boot assembly 20 as best seen in FIGS. 2-3. Boot assembly 20 may include a boot 22 that may be worn on the foot of the user. Boot 22 may be secured to the foot with the knee needing strengthening and therapy. Boot 22 may be worn with or without shoes. It is to be understood that boot 22 may be used to accommodate different users with different sized feet. Boot 22 may be entirely beneath the foot of the user. It is to be understood that boot 22 may preferably cover the entire sole of the foot of the user. Boot 22 may preferably be made of materials that are absorbent and cushioned to provide comfortable during usage. It is to be understood that physical therapy system 10 may include at least one of boot 22.

More specifically, as best seen in FIG. 3, boot 22 may include a sponge 24 within. Sponge 24 may be made of materials that are absorbent and cushioned to help provide comfort to the user while wearing boot 22. It is to be understood that sponge 24 may be the cushioned sole of boot 22. Sponge 24 may provide the height of boot 22. Sponge 24 may be substantially rectangular in one embodiment. It is to be understood that sponge 24 may provide the dimensions and shape for boot 22. Sponge 24 may compress as user places their foot on boot 22. It is to be understood that sponge 24 may be resilient to allow boot 22 and sponge 24 to maintain their original shape when the present invention is not in use. Sponge 24 may expand and compress depending on how users shift their weight on boot 22. Additionally, it is to be noted, that sponge 24 may help to maintain boot 22 lightweight.

It is to be understood that sponge 24 may be entirely enclosed by a cover 26. Cover 26 may be allow for boot 22 to easily slide on a surface. It is to be understood that, preferably, cover 26 may be made of materials or fabrics which are low friction when slid along a ground surface. In other words, materials for cover 26 may have a low coefficient of friction. It may be suitable for cover 26 to be made of materials such as cotton, nylon, polyester, wool, linen, spandex or combinations thereof. In one embodiment, cover 26 may be removable to allow for washing and cleaning of cover 26. Furthermore, it may be suitable for cover 26 to be removable to allow replacing thereof. Preferably, cover 26 may be entirely smooth along an outer surface thereof.

In order to allow for boot 22 to remain attached to users while physical therapy system 10 is in use, boot 22 may include a strap 28 mounted thereto. Strap 28 may be secured to lateral sides of boot 22 as best seen in FIGS. 1-3. Strap 28 may extend outwardly and away of boot 22. It may be seen that strap 28 may extend above of boot 22 and sponge 24. Strap 28 may include a semicircular shape that is to receive the foot of the user entirely underneath. It may be suitable for strap 28 to be flexible to allow stretching or expanding to comfortably secure different sized feet of users. It may be suitable for strap 28 to be elastic, in one embodiment. In one embodiment, strap 28 may be adjustable to allow fitting and accommodating users with different size feet. Strap 28 may also be adjustable to allow for better securement of the user's foot to boot 22. As best illustrated in FIGS. 2-3, boot 22 may include a reinforcing strap 32. Reinforcing strap 32 may extend about the perimeter of boot 22 on cover 26. Preferably, reinforcing strap 32 may extend both along the top and peripheral sides of boot 22. Reinforcing strap 32 may be rigid to provide added durability to boot 22. Reinforcing strap 22 may assist boot 22 in remaining usable after prolonged usage by minimizing damage to boot 22 and cover 26.

As best demonstrated in FIG. 1, boot assembly 20 may preferably be usage on track assembly 40. However, it may also be suitable to use and operate boot assembly 20 on a floor surface that is smooth. Track assembly 40 may include a track 42. Track 42 may alternatively be referred to as a mat. Track 42 may be of predetermined dimensions and shape. In one embodiment, track 42 may be rectangular in shape. Track 42 may provide a slidable surface for boot 22. Track 42, more specifically, the top surface of track 42 may be made of materials that cooperate and create little to no friction with boot 22 upon boot 22 being used thereon. The top surface of track 42 may include a low coefficient of friction. It may be suitable for track 42 to be made of materials such as plastic, rubber, wood, glass, carbon or combinations thereof. It is to be understood that the bottom surface of boot 22 may create friction with the floor surface in order to maintain track 42 stationary during usage. During usage of physical therapy system 10, only boot 22 may be in constant motion. In an alternate embodiment, track 42 may include indicia indicating the proper direction in which boot 22 is to be slid or rolled in. The indicia may be on the top surface of track 42.

It is to be understood that communications assembly 60 may be located within boot 22. Communications assembly 60 may be used to collect, analyze and provide data to the users. Communications 60 may also aid users in tracking their treatments to determine consistency. It is to be understood that communications assembly 60 may communicate with a mobile device 82 of the user. Communications assembly 60 may include a processor 62, sensors 64, a battery 66 and a wireless communication module 68.

Processor 62 may communicate with sensors 64 to gather data about the usage and operation of boot assembly 20. Sensors 64 may be used to determine the circumference of the motion user makes during usage of boot 22. Sensors 64 may also determine the direction of the motion of boot 22. Whether the motion is clockwise, counterclockwise, or in a line may be determined with sensors 64. The amount of completed repetitions with boot 22 may be determined with sensors 64 as well. A repetition being when a complete circular motion with a same start and end point is done. Further, the amount of pressure that the user applies to boot 22 during the physical therapy treatment is also determinable with sensors 64. All data collected by sensors 64 may be communicated to and stored by processor 62.

Battery 66 may be used to provide power and energy to processor 62 and sensors 64. It may be suitable for battery 66 to be rechargeable, in one embodiment. Battery 66 may alternatively be removable and replaceable. Battery 66 may be charged through standard wired means or wirelessly.

Mounted onto processor 62 may be wireless communication module 68. Wireless communication module 68 may be powered by the energy provided to processor 62. Wireless communication module 68 may provide wireless communication capabilities such as radio broadcast (RF), infrared (IR), microwave, Bluetooth, or Wi-Fi. Wireless communication module 68 may be used to communicate data received by processor 62 from sensors 64 to mobile device 82. Once the collected data is received by mobile device 82, users may track progress of the physical therapy. Further, users may track and record each therapy session with communication assembly 60.

Physical therapy system 10 may help users to improve their mobility and rehabilitate their body from an injury. More specifically, users may strengthen their knees post-injury. Physical therapy system 10 allows users to remain disciplined and receive physical therapy anywhere. Physical therapy system 10 may further help users to save money by requiring less visits to a physical therapist for treatment which may become costly over time. Boot 22 is secured to the foot where therapy is needed. The boot is maneuvered on track 42 in a manner that helps to improve the knee of the user. The needed maneuvers may be determined by a qualified physician or physical therapist. Preferably the motions to be completed with boot 22 are circular. Boot 22 may preferably be frictionless when slid on track 42. Continued usage of the physical therapy system 10 may result in a successful recovery and improved health for users.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A physical therapy system, comprising:

a. a shoe covering assembly including a shoe covering with a low coefficient of friction, said shoe covering adapted to cover the foot of the user on the same leg as a knee requiring knee rehabilitation, wherein said shoe covering assembly further includes a strap mounted to said shoe covering, said strap includes a first strap distal end and a second strap distal end, wherein said first strap distal end extends upwardly from a first lateral edge of a top side of the shoe covering, wherein said second strap distal end extends upwardly from a second lateral edge of said top side of said shoe covering, wherein said strap is a single solid piece made of an elastic material;

b. a track assembly including a track, said shoe covering maneuvered on said track adapted to help the user increase mobility on the knee needing rehabilitation;

c. a communication assembly including a processor and sensors, said sensors being within said shoe covering, said sensors collecting data about the movements of said shoe covering upon said track; and d. a mobile device, said data collected being communicated to the mobile device by said processor configurated to allow the user to record and track progress on said mobile device.

2. The system of claim 1, wherein said shoe covering includes a sponge within, said sponge being a cushioned sole.

3. The system of claim 2, wherein said sponge is entirely enclosed by a cover, said cover being entirely smooth and slidable on said track.

4. The system of claim 2, wherein said sponge expands and compresses during usage of the shoe covering.

5. The system of claim 1, wherein said strap adapted to secure the foot of the user to the shoe covering.

6. The system of claim 5, wherein said strap is secured to lateral sides of said shoe covering, said strap being above of said shoe covering.

7. The system of claim 5, wherein said strap is flexible and expandable.

8. The system of claim 1, wherein said shoe covering assembly includes a reinforcing strap, said reinforcing strap extending about the entire perimeter of said shoe covering, said reinforcing strap reinforcing said shoe covering for added durability.

9. The system of claim 8, wherein said reinforcing strap extends partially along a top and sides of said shoe covering.

10. The system of claim 1, wherein said processor assembly includes a battery, said battery being rechargeable.

11. The system of claim 10, wherein said battery is removable and replaceable.

12. The system of claim 10, wherein mounted to said processor is a wireless communication module, said wireless communication module transmitting the collected data to said mobile device.

13. The system of claim 12, wherein said processor, said sensors and said wireless communication module are powered by said battery.

14. The system of claim 12, wherein said wireless communication module is capable of communication through radio broadcast (RF), infrared (IR), microwave, Bluetooth, or Wi-Fi.

15. A physical therapy system, comprising:

a. a shoe covering assembly including a shoe covering with a low coefficient of friction, said shoe covering adapted to cover the foot of the user on the same leg as a knee requiring knee rehabilitation, said shoe covering further including a sponge, said sponge being a cushioned sole for said shoe covering, said sponge entirely enclosed by a cover, said cover made of a low friction material, said sponge being able to expand and compress, said shoe covering further including a strap mounted to said shoe covering, said strap includes a first strap distal end and a second strap distal end, wherein said first strap distal end extends upwardly from a first lateral edge of a top side of the shoe covering, wherein said second strap distal end extends upwardly from a second lateral edge of said top side of said shoe covering, said strap being semicircular, said strap extending outwardly and away from said shoe covering, said strap being substantially above said shoe covering, said shoe covering including a reinforcing strap extending about the perimeter of said shoe covering, said reinforcing strap being partially on a top and sides of said shoe covering, wherein said strap is a single solid piece made of an elastic material;

b. a track assembly including a track, said shoe covering maneuvered on said track adapted to help the user increase mobility on the knee needing rehabilitation, said track having a low friction coefficient allowing said shoe covering to glide thereon;

c. a communication assembly within said shoe covering including a processor, sensors, a battery and a wireless communication module, said sensors collecting data about the movements of said shoe covering upon said track, said data being communicated to said processor, said battery being rechargeable, said wireless communication module mounted onto said processor, said battery providing power to said processor and said sensors, said wireless communication module being capable of communication through radio broadcast (RF), infrared (IR), microwave, Bluetooth, or Wi-Fi; and d. a mobile device, said data collected being transmitted to the mobile device by said processor with said wireless communication module configurated to allow the user to record and track progress on said mobile device.

16. The system of claim 15, wherein said sensors determine the circumference of a motion the user makes with said shoe covering, said sensors determine the direction of the motion of the shoe covering, said sensors determine repetitions completed with said shoe covering.

17. A physical therapy system, consisting of:

a. a shoe covering assembly including a shoe covering with a low coefficient of friction, said shoe covering adapted to cover the foot of the user on the same leg as a knee requiring knee rehabilitation, said shoe covering further including a sponge, said sponge being a cushioned sole for said shoe covering, said sponge entirely enclosed by a cover, said cover made of a low friction material, said sponge being able to expand and compress, said shoe covering further including a strap mounted to said shoe covering, said strap includes a first strap distal end and a second strap distal end, wherein said first strap distal end extends upwardly from a first lateral edge of a top side of the shoe covering, wherein said second strap distal end extends upwardly from a second lateral edge of said top side of said shoe covering, said strap being semicircular, said strap extending outwardly and away from said shoe covering, said strap being substantially above of said shoe covering, said shoe covering including a reinforcing strap extending about the perimeter of said shoe covering, said reinforcing strap being partially on a top and sides of said shoe covering, wherein said strap is a single solid piece made of an elastic material;

b. a track assembly including a track, said shoe covering maneuvered on said track adapted to help the user increase mobility on the knee needing rehabilitation, said track having a low friction coefficient allowing said shoe covering to glide thereon;

c. a communication assembly within said shoe covering including a processor, sensors, a battery and a wireless communication module, said sensors collecting data about the movements of said shoe covering upon said track, said data being communicated to said processor, said battery being rechargeable, said wireless communication module mounted onto said processor, said battery providing power to said processor and said sensors, said wireless communication module being capable of communication through radio broadcast (RF), infrared (IR), microwave, Bluetooth, or Wi-Fi; and d. a mobile device, said data collected being transmitted to the mobile device by said processor with said wireless communication module configurated to allow the user to record and track progress on said mobile device, wherein said sensors determine the circumference of a motion the user makes with said shoe covering, said sensors determine the direction of the motion of the shoe covering, said sensors determine repetitions completed with said shoe covering.

* * * * *